United States Patent [19]

Barbe et al.

[11] Patent Number: 4,711,682

[45] Date of Patent: Dec. 8, 1987

[54] WALLPAPER APPLICATOR DEVICES AND METHOD FOR ITS USE

[76] Inventors: Christian Barbe, 3593 Jacqueline; Richard Barbe, 3591 Jacqueline, both of Laval, Quebec, Canada, H7P 5A6

[21] Appl. No.: 929,000

[22] Filed: Nov. 10, 1986

[51] Int. Cl.[4] ..... E04F 13/00; B44C 7/06

[52] U.S. Cl. ..... 156/71; 156/308.6; 156/575; 156/577; 156/579; 118/419; 118/DIG. 17

[58] Field of Search ..... 156/574, 575, 577, 579, 156/71, 308.6; 118/419, DIG. 17

[56] References Cited

U.S. PATENT DOCUMENTS

| | | | |
|---|---|---|---|
| 87,545 | 3/1869 | Clay | 156/575 |
| 2,794,419 | 6/1957 | Warner et al. | 118/419 |
| 2,898,883 | 8/1959 | Reid et al. | 118/419 |
| 3,568,635 | 3/1971 | Poitras et al. | 118/419 |
| 3,592,161 | 7/1971 | Hoffmann | 118/419 |
| 3,737,360 | 6/1973 | Horn | 156/577 |
| 3,861,988 | 1/1975 | Preisler | 156/577 |
| 3,907,628 | 9/1975 | Buske | 156/574 |
| 4,210,485 | 7/1980 | Lake | 156/575 |

FOREIGN PATENT DOCUMENTS

| | | | |
|---|---|---|---|
| 689066 | 6/1964 | Canada . | |
| 2409622 | 9/1974 | Fed. Rep. of Germany | 156/574 |

*Primary Examiner*—John E. Kittle
*Assistant Examiner*—Terry J. Owens

[57] ABSTRACT

A wallpaper applicator for single-handedly applying on a flat surface and in a single continuous stroke the sticky face of a wallpaper. The applicator is characterized in that it eliminates distortion of the wallpaper and formation of air bubbles in between the wallpaper and the applied surface. The device comprises an elongated cross-sectionally polygonal casing in which lies a web of wallpaper; the latter is biased against two of the flat side walls of the casing by a weight rod engaged in the cylindrical hollow defined by the wallpaper web. One casing flat side wall defines a longitudinal slot through which escapes the leading edge portion of the wallpaper.

6 Claims, 5 Drawing Figures

FIGURE 5

WALLPAPER APPLICATOR DEVICES AND METHOD FOR ITS USE

FIELD OF THE INVENTION

This invention relates to wallpaper applicators for flat surfaces.

BACKGROUND OF THE INVENTION

Prior art wallpaper applicator devices generally define a cylindrical elongated casing in which a web of wallpaper is loosely engaged, and having a longitudinal slot for exit of the wallpaper leading edge portion whereby the wallpaper is unrolled therethrough and applied and adhered against a desired surface.

One inherent disadvantage of such devices is that the wet web of wallpaper tends to stick within the casing during its unrolling, thereby hampering exiting of the wallpaper and thus inducing some uneven feeding of the wallpaper on the applied surface and, thus, distortion. This disadvantage is due to the cylindrical shape of the casing, which contacts the cylindrical wallpaper web over a large surface.

Another disadvantage of prior art devices is that the preglued surface of the wallpaper, which is conventionally moistened in a separate water basin immediately before use, tends to drip on the floor when exiting from the casing, and thus undesirably stains the floor.

Also, because of their construction, these devices are generally not adapted for applying wallpaper on a ceiling.

OBJECTS OF THE INVENTION

The general object of the present invention is to increase the efficiency of wallpaper applications on flat surfaces.

More specifically, the present invention, in accordance with its above-noted general object, is designed for precisely-effected applications of a single precut length on said surfaces, concurrently with eliminating the formation of air bubbles and distortion between the wallpaper and the applied surface, in the least time period.

A further object of the present invention is to provide a wallpaper applicator device which can be operated by a single person.

Another object of the above invention is to provide means to prevent the water and the glue compound from the applicator from dripping on the floor and staining same.

Still another object of the present invention is to provide such an applicator device which will support the web of wallpaper to prevent tearing thereof during use.

An object of the present invention is to provide such an applicator device which does not require that the user contact the sticky surface of the wallpaper with his fingers.

An object of this invention is to provide an applicator device that is operatively reversible.

SUMMARY OF THE INVENTION

There is disclosed in accordance with the objects of the invention an applicator device for applying wallpaper on flat surfaces including an elongated casing defining a cross-sectionally polygonal structure. The casing consists of at least two flat side walls and a third side wall having an intermediate longitudinal slot. The casing is closed at both ends by end plates, each end plate having a notch registering with said slot and a central through-bore, the casing being engaged by a web of said wallpaper. The leading edge portion of the said wallpaper extends through said longitudinal slot. A weight rod extends inside said casing between said end plates and through the cylindrical hollow defined by the wallpaper web, to bias the latter towards the intersecting edge of a pair of adjacent flat side walls. The exterior face of said third side wall has resilient presser members, longitudinally extending on either side of said slot spacedly thereof and adapted to compress said wallpaper against said flat surface upon said applicator device being slidingly applied against said flat surface.

DETAILED DESCRIPTION OF THE INVENTION

Figure 3:
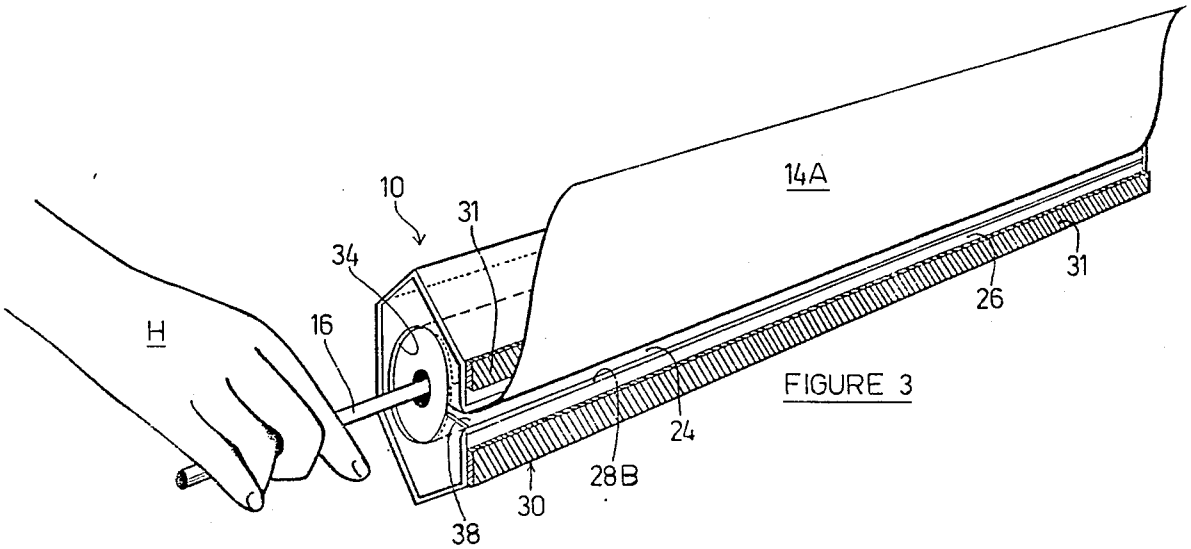
FIG. 3 is the view of FIG. 1, but with the web of wallpaper being completely engaged in said device and partially unrolled, and with the weight rod being partially engaged by the user's hand through said one end thereof.
Figure 4:
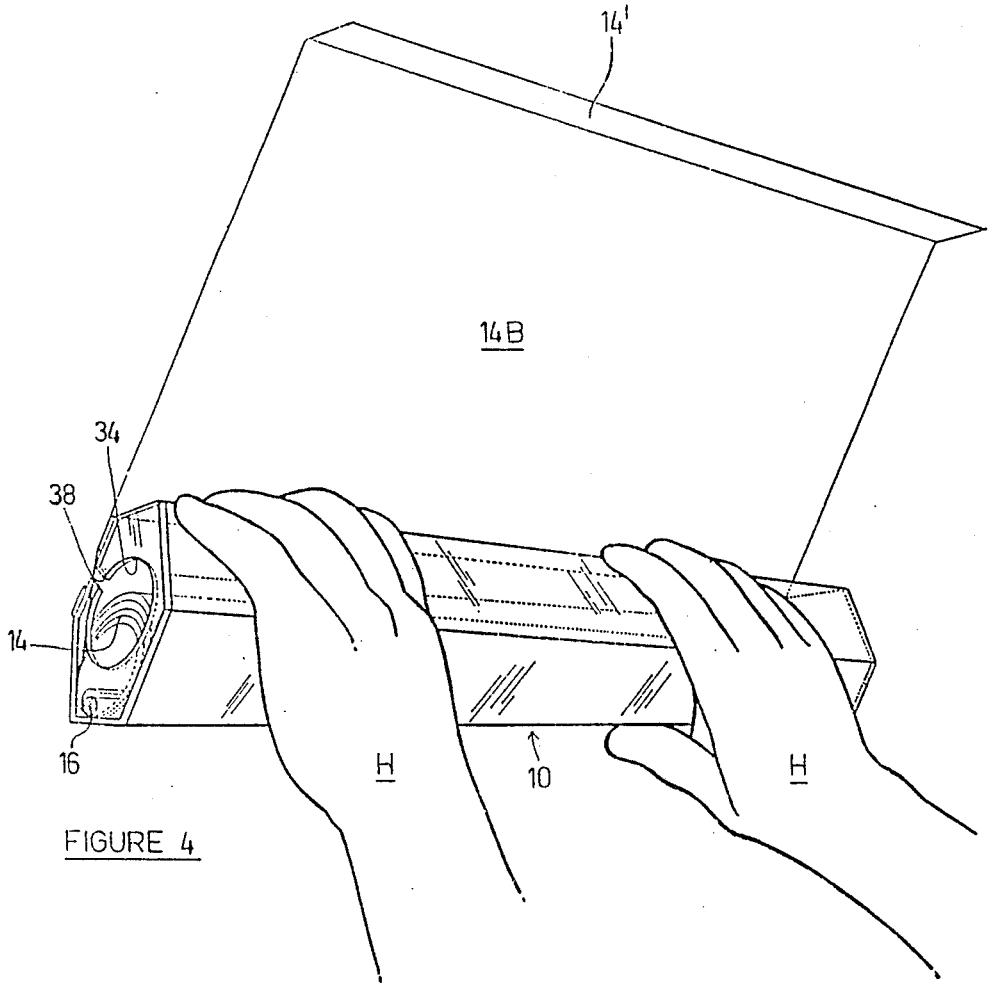
FIG. 4 shows how the wallpaper is applied by hand on a surface (not illustrated) by means of said wallpaper applicator device.

The wallpaper application device is denoted 10 in FIG. 3. It generally consists of an elongated hollow rigid casing 12 engageable by a rolled web of wallpaper 14. A weight rod 16 is engaged in the cylindrical hollow 18 defined by the core of the web of wallpaper 14.

More particularly, casing 12 defines a cross-sectionally polygonal structure which may have from three to eight flat sides, and preferably six. The preferred cross-sectionally hexagonal casing 12 defines five flat sides 20 and a sixth face 22 having an intermediate longitudinal slot 24. Face 22 thus defines two spaced longitudinal bands 25, 26, wherein the inner longitudinal edge of each band 25, 26 is preferably bevelled at 28A, 28B respectively. To the exterior face of each band 25, 26, is secured a strip of elastomeric material 30, spacedly from the corresponding bevelled edge 28A, 28B. Material 30, which may be rubber foam, is preferably enclosed in a velvet sheath 31.

The width of slot 24 must be at least a few times the thickness of the wallpaper 14, for easy engagement therethrough.

Each opposite end of casing 12 is closed by an end plate 32. Each end plate 32 comprises a large circular central through-bore 34, for engagement therethrough by the tightly rolled web of wallpaper 14. Each end plate 32 is hexagonal; in the preferred embodiment of the invention, and frictionally fits within the walls of casing 12, wherein the end edges 35, 36, of the casing side walls 20, 22, respectively are flush with the exterior face of the end plates 32. Each end plate 32 defines a transverse notch 38 whose sides are radially-outwardly-extending and registering with the slot 24. Each end plate 32 could be permanently fixed to casing 12.

Weight rod 16 is shorter than the distance between end plates 32, and loosely lies therebetween. Weight rod 16 would be made of a material of high density, so as to be able to bias under gravitational force the web of wallpaper 14 towards the intersecting edge 20' of a pair of the casing flat side walls 20.

By design, the wallpaper application device 10 is reversible, i.e. that it can be used on either side, with respect to bevelled edges 28A, 28B, being alternately the lower bevelled edge of the slot 24.

Figure 1:
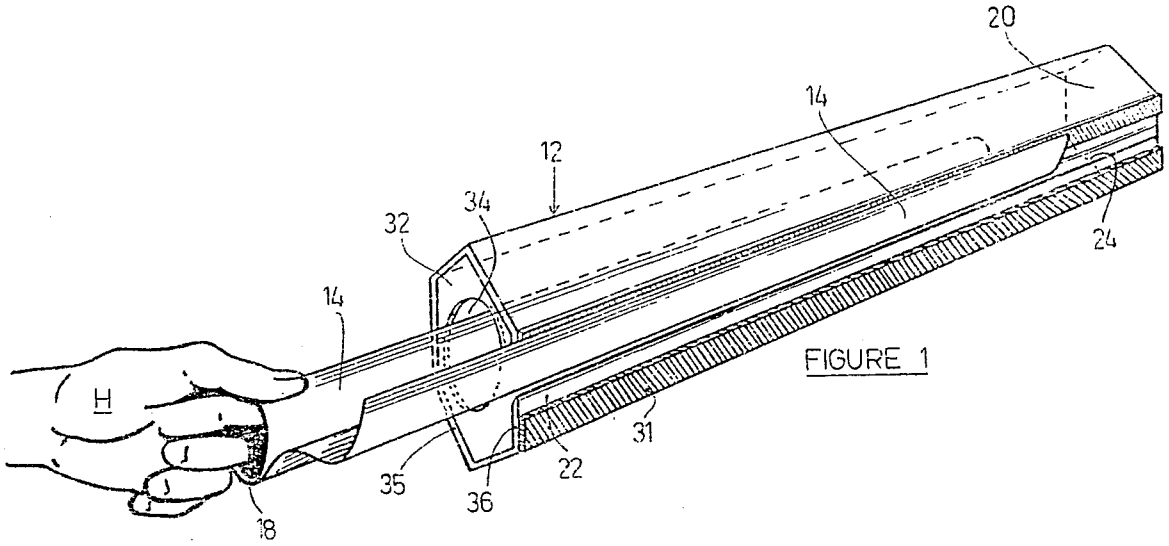
FIG. 1 is a side perspective view of the casing of a wallpaper applicator device according to the invention, showing a web of wallpaper partially engaged by a user's hand through one end thereof.
Figure 2:
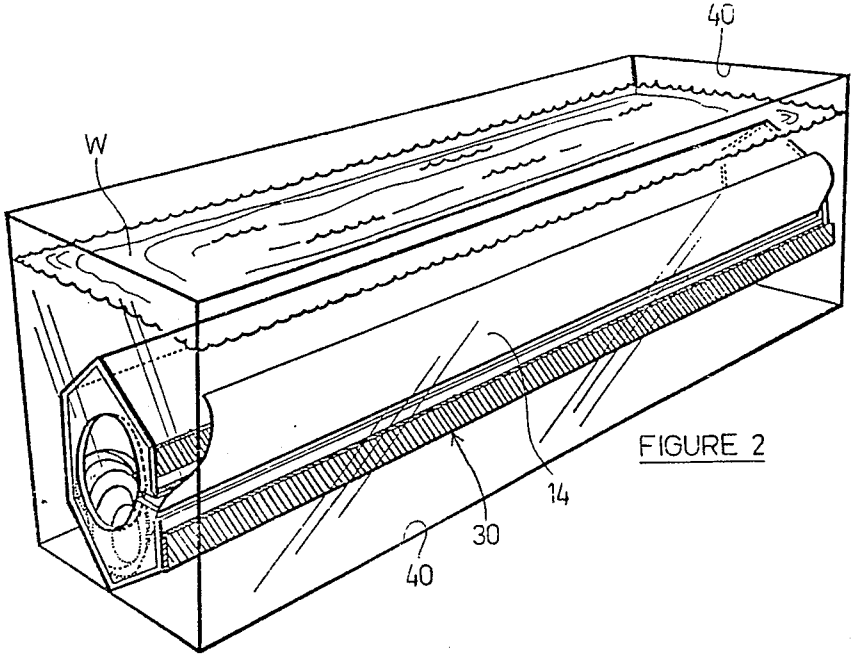
FIG. 2 is a side perspective view of a soaking basin for the wallpaper and applicator device, showing the latter therein.
Figure 5:
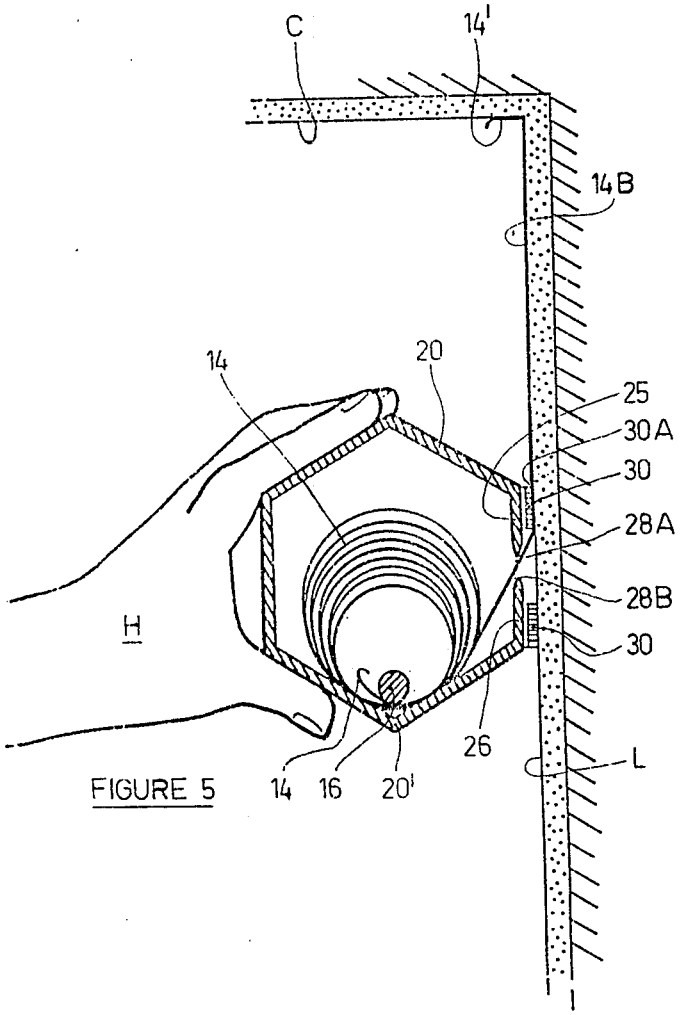
FIG. 5 is a cross-sectional view of said wallpaper applicator device and of the corner portion of a ceiling and adjacent wall, showing a wallpaper applied on the wall, and a supporting user's hand in full lines.

The device 10 is used as follows. The roll of wallpaper 14 is tightly wound with its preglued surface 14A on the outside and is inserted within casing 12 through hole 34 of one end wall 32 with the leading portion of the wallpaper inserted through slot 24 as shown in FIG. 1. Then the casing 12 is grasped with one hand while the roll 14 is held against self-unwinding with the other hand. The assembly is immersed in a basin 40 full of water; then the roll 14 is released. The tightly rolled web of wallpaper 14 will then partially unwind while in water thus creating a counter-rotational circulation of water which will fully moisten all the preglued surface 14A of the wallpaper 14. The soaking period in the basin should vary between 20 and 30 seconds. The casing 12 is then removed from the basin and the water allowed to discharge from the casing 12. Rod 16 is then inserted within the wallpaper roll as shown in FIG. 3. The assembly is then ready for use. The leading portion of the wallpaper is then pulled out of casing 12 to about 8 inches through slot 24. This leading portion is manually applied against ceiling C as shown in FIG. 5 and then down a short distance along wall L. When it is not desired to cover the ceiling C with wallpaper, the leading edge is directly applied to wall L adjacent ceiling C. The application is continued by pulling down the device 10 along wall L while pressing the device against the wall whereby the wallpaper will unroll through longitudinal slot 24.

The top elastomeric strip 30 on face band 25 in FIG. 5 constitutes a presser member, which prevents formation of air bubbles between the wallpaper 14 and the wall L.

This operation can be done in a single continuous downwardly-extending stroke, thereby preventing the distortion of wallpaper. The wallpaper 14 is sectioned at the floor level, or other desired level, and the same operation is repeated for other flat surfaces on which the wallpaper is to be applied.

The weight rod 16 is useful in preventing the wallpaper from gathering about the longitudinal slot 24 during its unrolling and also in causing the wallpaper to be kept in contact with the small amount of water remaining in casing 12. Therefore, the wallpaper is perfectly moistened as it exits from the casing.

As shown in FIG. 5, since the wet glued surface of rolled wallpaper 14 contacts very narrow portions of the inner surface of casing 12, a minimum of friction is exerted on the wallpaper roll during its unrolling.

Since the longitudinal slot 24 and holes 34 of end walls 32 are positioned clearly above the lowermost portion of the casing 12 during application of the wallpaper 14, no remaining water within the casing will be allowed to drip on the floor.

The top presser member 30 is also useful in that it wipes the exposed face of the wallpaper sliding through slot 24 and the wiped water falls back into casing 12. Thus, staining of the floor is prevented.

Bevels 28A, 28B are useful in that they concurrently constitute guide means, for guiding the exiting of the wallpaper through the slot 24.

What we claimed is:

1. An applicator device for applying wallpaper on a flat surface, including an elongated casing defining a cross-sectionally polygonal structure, the casing consisting of at least two flat side walls and a third side wall having an intermediate longitudinal slot, end plates closing both ends of said casing, each end plate having a notch registering with said slot and a central throughbore through which a rolled web of said wallpaper is insertable into said casing with the leading edge portion of said wallpaper extending through said longitudinal slot, and further including a weight rod adapted to extend inside said casing between said end plates and through the cylindrical hollow defined by the rolled wallpaper web to bias the latter against a pair of adjacent flat side walls of said casing, the exterior face of said third side wall having resilient presser members longitudinally extending on either side of said slot spacedly thereof and adapted to press said wallpaper against said flat surface upon said applicator device being slidingly applied against said flat surface.

2. The applicator device as in claim 1, wherein said casing has a maximum of eight side walls and a minimum of three side walls.

3. The applicator device as in claim 1, wherein said casing is cross-sectionally hexagonal.

4. The applicator device as in claim 1, wherein each said presser member includes a strip of elastomeric material.

5. The applicator device as in claim 1, wherein both free inner edges of said third side wall defining the longitudinal edges of said slot are bevelled to constitute guide means for said wallpaper.

6. A method for applying wallpaper on a flat surface with an applicator device, including the following steps:

(1) tightly rolling into a web a wallpaper having a preglued face;

(2) engaging said web into an elongated casing through a bore at one end thereof, to constitute said applicator device;

(3) pulling the leading edge portion of the wallpaper outwardly therefrom through a longitudinal slot formed along a wall of said casing;

(4) immersing the said applicator device into a water basin and then releasing the tightly rolled web, whereby said web partially unrolls and thereby produces a counter-rotational circulation of water within said casing which moistens all of the said preglued surface of the wallpaper;

(5) removing same from the basin;

(6) inserting a weight rod within the rolled web;

(7) applying said wallpaper leading portion against a surface; and (8) displacing said casing along said surface while pressing said casing thereagainst.

* * * * *